US009419364B2

(12) United States Patent
Devos et al.

(10) Patent No.: US 9,419,364 B2
(45) Date of Patent: Aug. 16, 2016

(54) FLAT CONTACT FOR A CONNECTOR, RECEIVING BLOCK FOR A FLAT CONTACT AND CONNECTOR

(71) Applicant: Tyco Electronics Belgium EC BVBA, Oostkamp (BE)

(72) Inventors: Peter Devos, Wondelgem (BE); Rik Danneels, Zwevezele (BE); Thomas Ryckx, Wingene (BE); Lieven Dossche, Wingene (BE)

(73) Assignee: Tyco Electronics Belgium EC BVBA, Oostkamp (BE)

( * ) Notice: Subject to any disclaimer, the term of this patent is extended or adjusted under 35 U.S.C. 154(b) by 0 days.

(21) Appl. No.: 14/448,561

(22) Filed: Jul. 31, 2014

(65) Prior Publication Data

US 2015/0038023 A1 Feb. 5, 2015

(30) Foreign Application Priority Data

Aug. 2, 2013 (DE) ..... 10 2013 215 302

(51) Int. Cl.

| | |
|---|---|
| ***H01R 13/40*** | (2006.01) |
| ***H01R 13/41*** | (2006.01) |
| *H01R 12/58* | (2011.01) |

(52) U.S. Cl.
CPC ..... *H01R 13/41* (2013.01); *H01R 12/58* (2013.01)

(58) Field of Classification Search
CPC ..... H01R 13/4223; H01R 13/2442
USPC ..... 439/752.5, 342, 832, 862, 606, 733.1, 439/226, 249
See application file for complete search history.

(56) References Cited

U.S. PATENT DOCUMENTS

2009/0117755 A1* 5/2009 Tonosaki ..... 439/55

* cited by examiner

*Primary Examiner* — Phuongchi T Nguyen
(74) *Attorney, Agent, or Firm* — Faegre Baker Daniels LLP

(57) ABSTRACT

The disclosure relates to a flat contact for insertion in a receiving member of a connector in an insertion direction (E), a receiving block for inserting the flat contact, and a connector comprising a receiving block and/or a flat contact. A solution is provided in which the positioning of a flat contact relative to the receiving block is simple and precise. This is achieved by a flat contact for insertion in a receiving member of a connector in an insertion direction (E) comprising a clamping portion having clamping projections which protrude in a width direction (B) and a positioning portion which has at the narrow sides thereof guiding faces which extend parallel with the insertion direction (E), the guiding faces projecting beyond the clamping projections in the width direction (B).

21 Claims, 10 Drawing Sheets

FLAT CONTACT FOR A CONNECTOR, RECEIVING BLOCK FOR A FLAT CONTACT AND CONNECTOR

This application claims priority from German Patent Application DE102013215302.3 filed Aug. 2, 2013, the subject matter of which is incorporated herein by reference.

BACKGROUND

The invention relates to a flat contact for insertion in a receiving member of a connector in an insertion direction, a receiving block for inserting the flat contact and a connector comprising a receiving block and/or a flat contact.

It is known to produce connectors by a flat contact being inserted into a receiving member of a receiving block. However, it is disadvantageous in previous systems that the positioning of the flat contacts relative to the receiving block is difficult. Subsequent adjustment is often required, whereby the production costs are relatively high.

SUMMARY

An object of the invention is to provide a solution in which the positioning of a flat contact relative to the receiving block is simple and precise.

According to the invention, this is achieved by means of a flat contact for insertion in a receiving member of a connector in an insertion direction, comprising a clamping portion having clamping projections which protrude in a width direction and a positioning portion which has at the narrow sides thereof guiding faces which extend parallel with the insertion direction, the guiding faces projecting beyond the clamping projections in the width direction. A receiving block according to the invention for inserting a flat contact in an insertion direction comprises at least one receiving member for the flat contact, the receiving member having a counter-positioning portion having counter-guiding faces which extend parallel with the insertion direction and a counter-clamping portion, an inner width of the counter-positioning portion measured in a width direction which extends perpendicularly relative to the insertion direction being greater than an inner width of the counter-clamping portion. A connector according to the invention comprises a receiving block according to the invention and/or a flat contact according to the invention.

The clamping portion with the clamping projections thereof is used for securing in the receiving member of the receiving block. The positioning portion enables simple and precise positioning of the flat contact since its guiding faces project beyond the clamping projections in the width direction. The guiding faces which extend parallel with the insertion direction ensure straight introduction in this instance. Subsequent adjustment may be dispensed with.

The solution according to the invention can be further improved with the additional embodiments and developments which are advantageous per se and which can be freely combined with each other.

In an advantageous embodiment, the width of the positioning portion is between 120 and 500%, preferably between 120 and 200%, and in a particularly preferred manner between 130 and 150%, of the width of the clamping portion. Such a width ensures sufficiently good positioning and at the same time does not take up an excessive amount of space in the width direction. The wider the positioning portion is, the more precisely the flat contact can be positioned since a deviation by a specific distance at the guiding faces with increasing width leads to increasingly small deviations in the centre. With connectors having a single flat contact, a particularly wide positioning portion can be selected in order to position the flat contact in the most precise manner possible. For connectors having a plurality of flat contacts, the spatial dimensions of the receiving members are intended to be taken into account. A good compromise, which enables both precise positioning and a compact structural shape of the connector, is in the range from 120 to 200%, the number of flat contacts of the connector and the dimensions thereof naturally also being significant. The width of the positioning portion and the clamping portion are measured in each case at the widest locations, with the clamping portion therefore at the outer side at the clamping projections and with the positioning portions at the guiding faces.

In order to further improve the positioning, the flat contact may have a second positioning portion having guiding faces which extend parallel with the insertion direction, the clamping portion being located between the first and the second positioning portion. Owing to the fact that the two positioning portions are located at different sides of the clamping portion, they enable precise positioning of the clamping portion. Since the first positioning portion is wider than the clamping portion, it is preferably located in the insertion direction downstream of the clamping portion, that is to say, the clamping portion is introduced into the receiving member upstream of the first positioning portion. If the clamping portion is located between the first and the second positioning portion, therefore, the second positioning portion is located in the insertion direction upstream of the clamping portion and is preferably not wider than the clamping portion. In a preferred embodiment, the width of the first positioning portion is from 150 to 500%, preferably from 180 to 250%, of the width of the second positioning portion. In this range, a balanced relationship is produced between the positionability and the spatial requirement.

If two positioning portions are present, between which a clamping portion is located, the first positioning portion may be wider than the clamping portion and the clamping portion may in turn be wider than the second positioning portion. Such a flat contact tapers and is substantially wedge-like. Simple introduction of the flat contact into the receiving member is thereby enabled.

In an advantageous embodiment, in the clamping portion the clamping projections protrude from a base with a width which remains consistent in the insertion direction, the width of the base in the clamping portion corresponding to the width of the second positioning portion. During the insertion operation, the second positioning portion can be guided on a corresponding counter-positioning portion. During the subsequent insertion operation, the clamping portion comes into contact with the counter-positioning portion wherein, owing to the same width of the base and the second positioning portion, the counter-positioning portion can now be used for clamping. In such an embodiment of the flat contact, the counter-positioning portion performs a dual function and is used to position and to clamp.

The clamping projections in the clamping portion may be constructed differently. In an advantageous embodiment, the clamping projections extend in a wedge-like manner so that the flat contacts can be readily introduced into the receiving members and are securely engaged after the introduction operation.

In order to further improve the retention action, a flat contact may have two clamping portions which are located one behind the other in the insertion direction and in which clamping projections protrude in each case from a base with a width which remains consistent in the insertion direction, the base of a first clamping portion having a smaller width than the base of a second clamping portion which is located downstream of the first clamping portion in the insertion direction. Owing to this stepped embodiment, the clamping projections of the second clamping portion engage in a counter-clamping portion of a receiving member which has not yet been deformed or has been deformed only slightly by the first clamping portion. This further increases the clamping effect. The width of the first clamping portion measured at the clamping projections may be smaller than or equal to the width of the base of the second clamping portion. It is further particularly advantageous for the width of the base of the first clamping portion to correspond to the width of the second positioning portion.

If two clamping portions are present, the width of the base of the first clamping portion may be optionally from 25 to 90%, preferably from 70 to 90% and, in a particularly preferred manner, from 80 to 85%, of the width of the base of the second clamping portion. In such an embodiment, the first clamping portion may at the same time perform a guiding function for the flat contact. In this instance, it does not yet deform the second counter-clamping portion which is associated with the second clamping portion. On the whole, the flat contact is still sufficiently stable.

In an advantageous embodiment, the flat contact is a punched component. Punched components can be produced in a particularly simple and cost-effective manner, even in relatively large quantities. The receiving block may be an injection-moulded component. It may, for example, be produced from a thermoplastic plastics material. Injection-moulded components can be produced in a simple and cost-effective manner.

In an advantageous embodiment of the receiving block, the inner width of the counter-positioning portion is between 120 and 500%, preferably between 120 and 200% and in a particularly preferred manner between 130 and 150%, of the inner width of the counter-clamping portion. Good positioning is thereby ensured, with the spatial requirement not being too great. At the same time, such a receiving member can be readily removed from the mould in an injection-moulding method.

For better positioning, the receiving member may have a second counter-positioning portion, the counter-clamping portion being located between the first and the second counter-positioning portion. The counter-clamping portion thus separates the second and the first counter-positioning portion spatially, whereby the precision during the positioning is increased in comparison with two directly adjacent counter-positioning portions.

Advantageously, the inner clear width of the first counter-positioning portion is from 150 to 500%, preferably from 180 to 250%, of the inner width of the second counter-positioning portion. This represents a good compromise between positionability and material complexity. Furthermore, a receiving member constructed in this manner can be readily produced when the receiving block is an injection-moulded component.

In an advantageous embodiment, the second counter-positioning portion acts as a counter-clamping portion. When a flat contact is introduced, the counter-positioning portion is first used to position and, when introduced further, acts as a counter-clamping portion for a clamping portion of the flat contact. The counter-positioning portion in this instance carries out a dual function, whereby the receiving member can be constructed to be more compact in the insertion direction than with two individually formed portions.

In an advantageous embodiment, the counter-positioning portion comprises two part-portions which are located at two ends of the receiving member located in the width direction and which are separated by a recess which extends transversely relative to the width direction. The positioning is carried out in this instance at the two part-portions. The recess which is located between the two part-portions may facilitate the production, in particular if it involves an injection-moulded component. In the region of the recess, a negative portion which is required during production and which keeps the space free for the receiving member can be constructed to be thicker and therefore more stable than when the receiving member is constructed in a slot-like manner.

In order to further improve the positioning of the flat contact, the counter-positioning portion and/or the counter-clamping portion may have support faces which oppose each other in the thickness direction and whose spacing in the thickness direction is adapted to the thickness of the flat contact in the clamping portion or positioning portion. The opposing support faces preferably extend parallel with each other. The support faces preferably extend in the plane which is perpendicular relative to the thickness direction. The spacing of the support faces of the counter-positioning portion may substantially correspond to the spacing of the support faces of the counter-clamping portion.

In order to construct the introduction of the flat contact in a simple manner, the receiving member may be constructed in a funnel-like manner in the region of the introduction opening. Furthermore, the receiving member may have transition portions which extend in an oblique manner and which guide the flat contact between two portions which extend in a straight manner.

In order to receive deformed material and to achieve better retention, there may be provided behind the clamping portion a neck portion at which the cross-section is reduced.

The invention is explained in greater detail by way of example below with reference to advantageous embodiments and the drawings. The features which are described in this instance may be freely combined with each other as set out above and/or omitted, as desired in accordance with the application.

DETAILED DESCRIPTION

Figure 1:
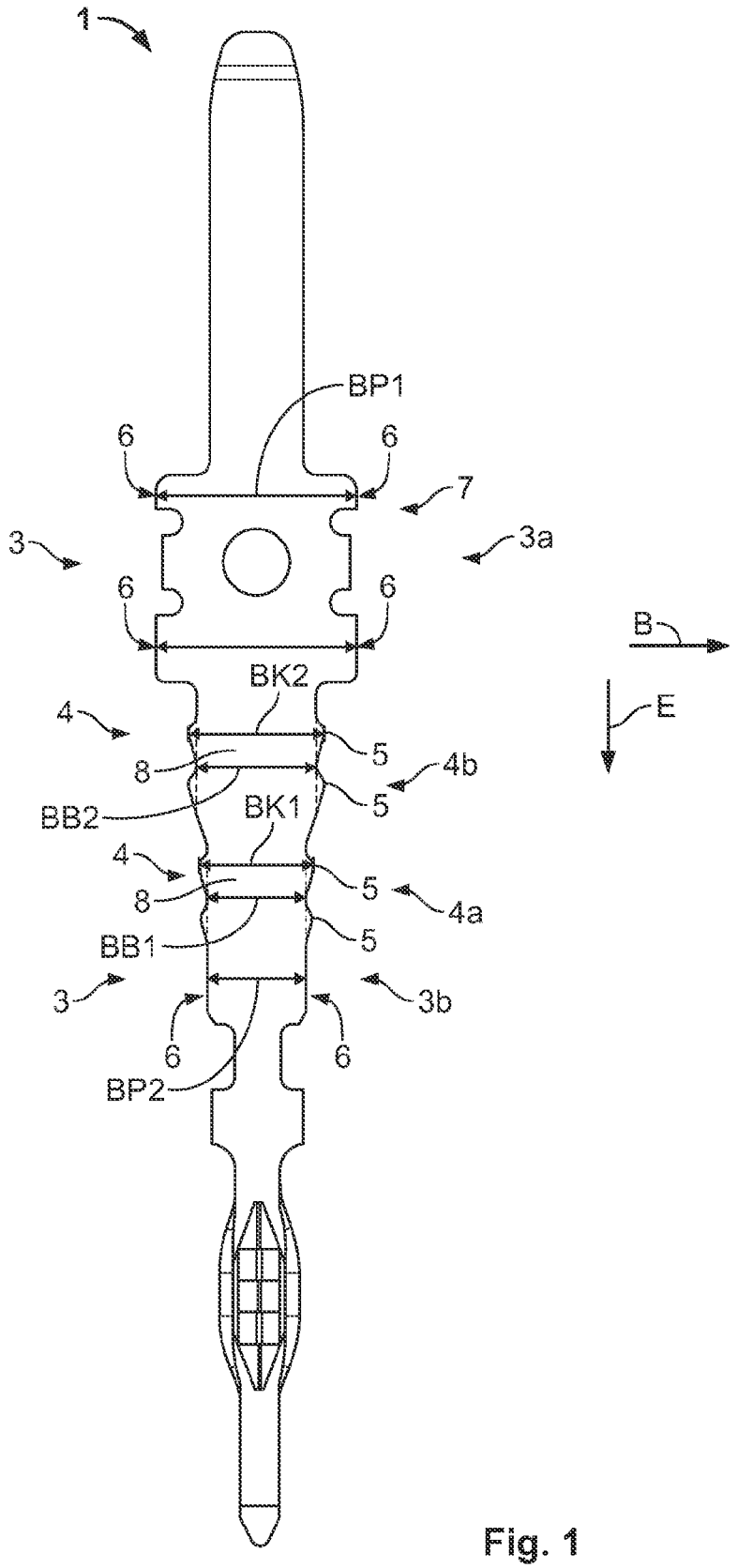
FIG. 1 is a schematic side view of a flat contact.

FIG. 1 shows a flat contact 1. It can be introduced in an insertion direction E into a receiving member 2 (see FIG. 2). The flat contact 1 is a punched component which has been punched from a metal sheet.

The flat contact 1 illustrated has two positioning portions 3 which ensure automatic positioning in the receiving member 2. Between the two positioning portions 3 are two clamping portions 4 which each have clamping projections 5 which protrude in a width direction B. The width direction B extends perpendicularly relative to the insertion direction E and in the plane of the flat contact 1. The positioning portions 3 each have guiding faces 6 which extend parallel with the insertion direction E and which are arranged at the narrow sides 6 of the flat contact 1. The guiding faces 6 of a first positioning portion 3*a* project beyond the clamping projections 5 of the clamping portions 4 in the width direction B. This first positioning portion 3*a* is arranged in the insertion direction E downstream of the two clamping portions 4 and a second positioning portion 3*b*. The width BP1 of the first positioning portion measured in the region of the guiding faces 6 is approximately 145% of the width BK2 of the second clamping portion 4*b* measured in the region of a clamping projection 5, which second clamping portion 4*b* is located in the insertion direction E downstream of the first clamping portion 4*a*. The width BK1 of the first clamping portion, measured at the widest location of the clamping projections 5, is in turn approximately 85% of the width BK2 of the second clamping portion.

Both clamping portions each have a base 8, which remains uniform in the insertion direction E in terms of the width thereof. From this base 8, the clamping projections 5 protrude in the width direction B. The width BK1 of the first clamping portion measured in the region of the clamping projections 5 substantially corresponds to the width BB2 of the base 8 of the second clamping portion 4*b*. During the introduction operation, the clamping projections 5 of the first clamping portion 4*a* consequently do not deform the corresponding counter-portions of the receiving member 2 and the clamping projections 5 of the second clamping portion 4*b* engage in undamaged material, whereby the retention effect is increased.

The width BP2 of the second positioning portion 3*b* again corresponds to the width BB1 of the base 8 of the first clamping portion 4*a*. The corresponding counter-portion in the receiving member 2 may thereby serve in a first step together with the second positioning portion 3*b* to position the flat contact. In a subsequent step, this counter-portion is used for clamping to the first clamping portion 4*a*.

The first positioning portion 3*a* is wider than the second clamping portion 4*b*. This is in turn wider than the second positioning portion 3*b*. Owing to this embodiment, the flat contact 1 can be readily introduced into the receiving member 2.

The width BP1 of the first positioning portion 3*a* is approximately 200% of the width BP2 of the second positioning portion. This is a compromise of good positionability and spatial requirement in the width direction B. The wider the first positioning portion 3*a* is, the more precise a positioning operation is. However, the flat contact 1 is often used together with other flat contacts 1 in a connector, whereby the width is limited owing to the dimensions of the connector. The spacing between the first positioning portion 3*a* and the second positioning portion 3*b* in the insertion direction E also determines the precision of the positioning. This spacing is limited by the dimensions of the receiving member 2 in the insertion direction E.

The two clamping portions 4 are located in the insertion direction E between the first positioning portion 3*a* and the second positioning portion 3*b*. In contrast to two directly adjacent positioning portions 3, in this embodiment a more precise positioning is possible since a deviation at one of the positioning portions 3 leads only to a deviation of the positions of the clamping portions 4, which deviation is smaller than the deviation at the positioning portion 3.

Figure 2:
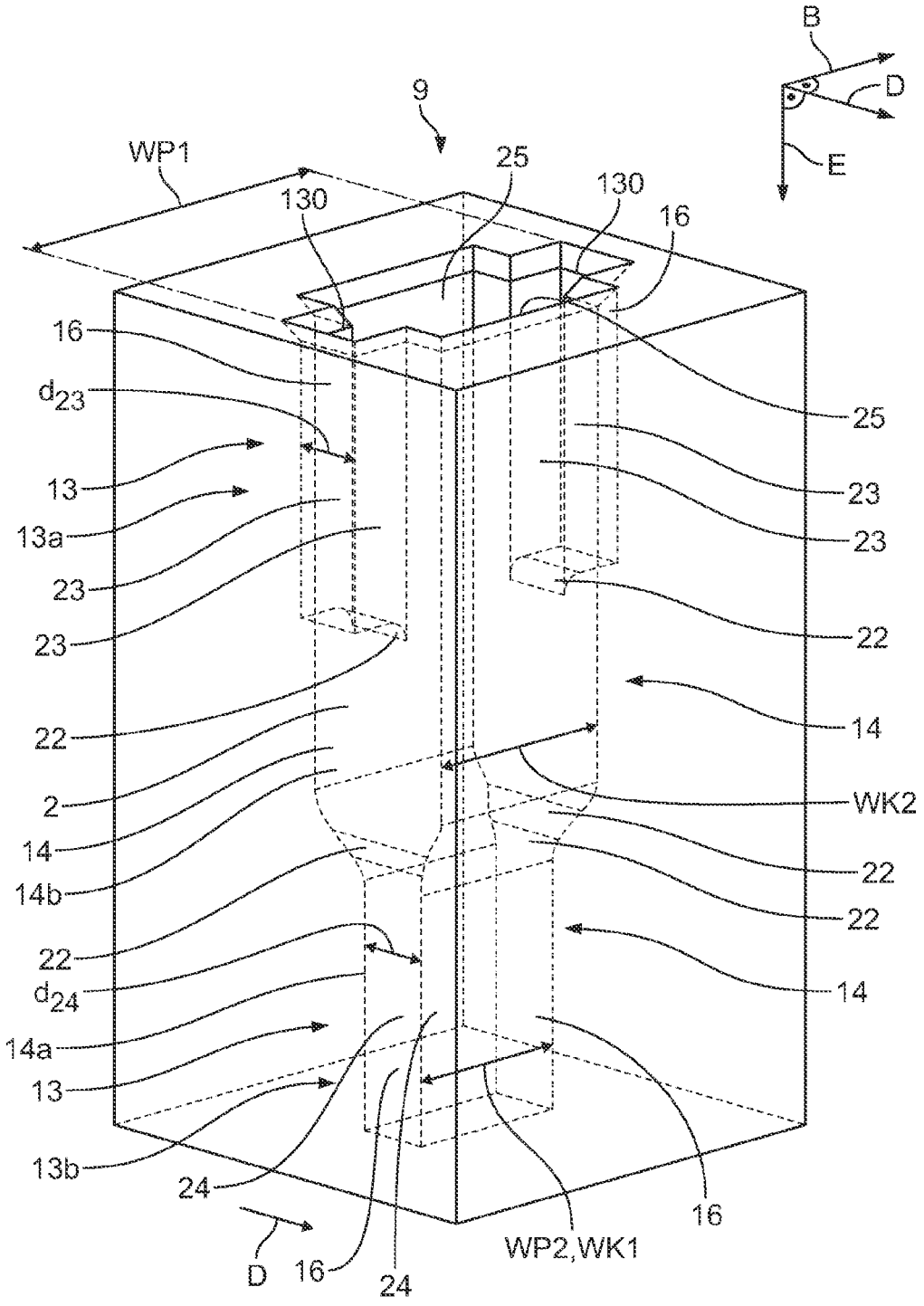
FIG. 2 is a schematic, perspective view of a receiving member.

FIG. 2 illustrates a receiving member 2 for a flat contact 1. This is a schematic illustration, which shows a cut-out of a receiving block 20.

The receiving member 2 has two counter-positioning portions 13, which are associated with the positioning portions of the flat contact 1. The counter-positioning portions 13 each have counter-guiding faces 16 which extend parallel with the insertion direction E. Between the two counter-positioning portions 13 is a counter-clamping portion 14 which is associated with the second clamping portion 4 of the flat contact 1. The second counter-positioning portion 13*b* which is further away from an introduction opening 9 also acts as a counter-clamping portion 14 for the first clamping portion 4*a* of the flat contact 1.

The inner widths measured in the width direction B correspond to the widths of the positioning portions 3 or the widths of the bases 8 of the clamping portions 4. The inner width WP1 of the first counter-positioning portion 13*a* adjacent to the introduction opening 9 corresponds to the width BP1 of the first positioning portion 3*a*. The inner width WP2 of the second counter-positioning portion 13*b* which acts at the same time as a first clamping portion 14*a* corresponds to the width BP2 of the second positioning portion 3*b* or the width BB1 of the base 8 of the first clamping portion 4*a* and can at the same time be considered to be the inner width of the first counter-clamping portion 14*a*. The inner width WK2 of the second counter-clamping portion 14*b* corresponds to the width BB2 of the base 8 of the second clamping portion 4*b*.

At the introduction opening 9, there are lateral inclined introduction members 21 which facilitate introduction of the flat contact 1. The introduction opening 9 is constructed in a funnel-shaped manner. Between the second clamping portion 14*b* and the first clamping portion 14*a* there are a plurality of oblique faces 22 which introduce the flat contact 1 into the first clamping portion 14*a*. Between the first counter-positioning portion 13*a* and the second clamping portion 14*b* there are also oblique faces 22 which guide the flat contact 1.

The first counter-positioning portion 13*a* is divided into two part-portions 130 which are located at two ends of the receiving member 2 located in the width direction B and are separated by a recess 25 which extends transversely relative to the width direction B. This recess 25 expands the slot formed by the counter-positioning portion 13*a* perpendicularly relative to the width direction B in the thickness direction D. Such an embodiment has the advantage that, during formation in an injection-moulding method, fewer filigree negative portions are required to produce the receiving members 2. Perpendicularly relative to the width direction B, such a negative shape may be thicker than in a slot-like embodiment. The production complexity is reduced and the production costs are thereby lower. In the region of the introduction opening 9, the cross-section of the receiving member 2 is thus substantially in the form of a cross or a plus sign. The receiving members 25 continue in the region of the second counter-clamping portion 14*b* so that the second counter-clamping portion 14*b* has an inner width which is measured perpendicularly relative to the width direction B and which is greater than required to receive the flat contact 1. The cross-section is rectangular in this instance. In the region of the first counter-clamping portion 14*a*, which at the same time is the second counter-positioning portion 13*b*, the inner width measured perpendicularly relative to the width direction B decreases to the material thickness of the flat contact 1 in order to ensure positioning in the thickness direction D which extends perpendicularly relative to the width direction B and perpendicularly relative to the insertion direction E. The inner width measured here in the thickness direction D corresponds to the inner width in the region of the part-portions 130 of the first counter-positioning portion 13*a*.

In the embodiment shown in FIG. 2, the counter-positioning portion 13 and the counter-clamping portion 14 have support faces 23, 24 which oppose each other in the thickness direction D and whose spacing $d_{23}$, $d_{24}$ in the thickness direction D is adapted to the thickness d of the flat contact 1 in the clamping portion 4 or positioning portion 3. The spacing $d_{23}$, $d_{24}$ is in this instance sized in such a manner that it substantially corresponds to the thickness d of the flat contact 1, that is to say, there is on the one hand sufficient play to press the flat contact 1 in but the play is sufficiently tight to position the flat contact 1 in a fixed manner in the thickness direction D. The opposing support faces 23 and 24 extend parallel and extend in the plane which is perpendicular relative to the thickness direction D. The spacing $d_{23}$ of the support faces 23 of the counter-positioning portion 13 substantially corresponds to the spacing $d_{24}$ of the support faces 24 of the counter-clamping portion 14. In this manner, a precise positioning of the flat contact 1 is achieved both in the width direction B and in the thickness direction D.

Figure 3:
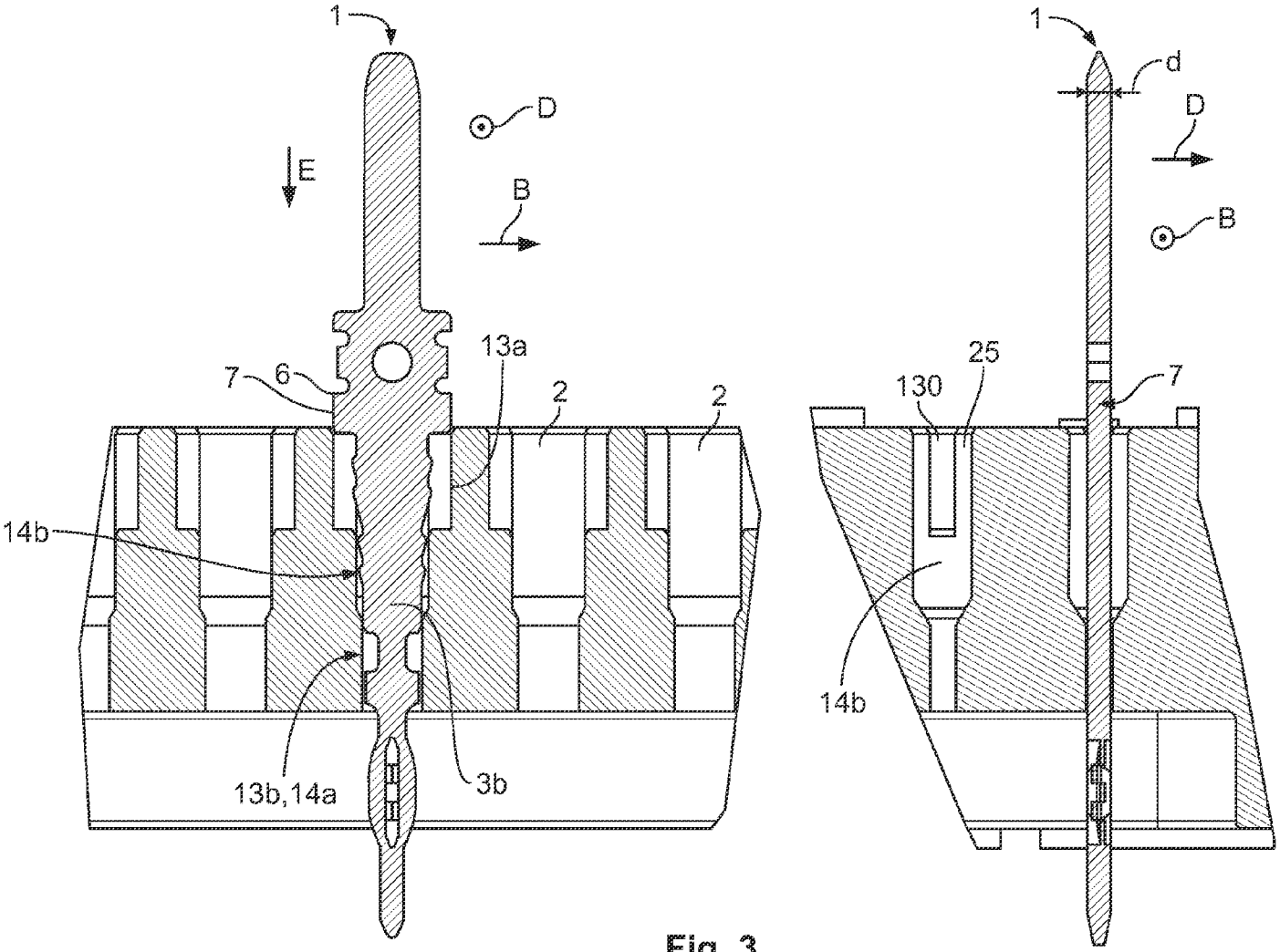
FIG. 3 shows two schematic side views of a flat contact together with a portion of a receiving block during a first step of an insertion operation.
Figure 4:
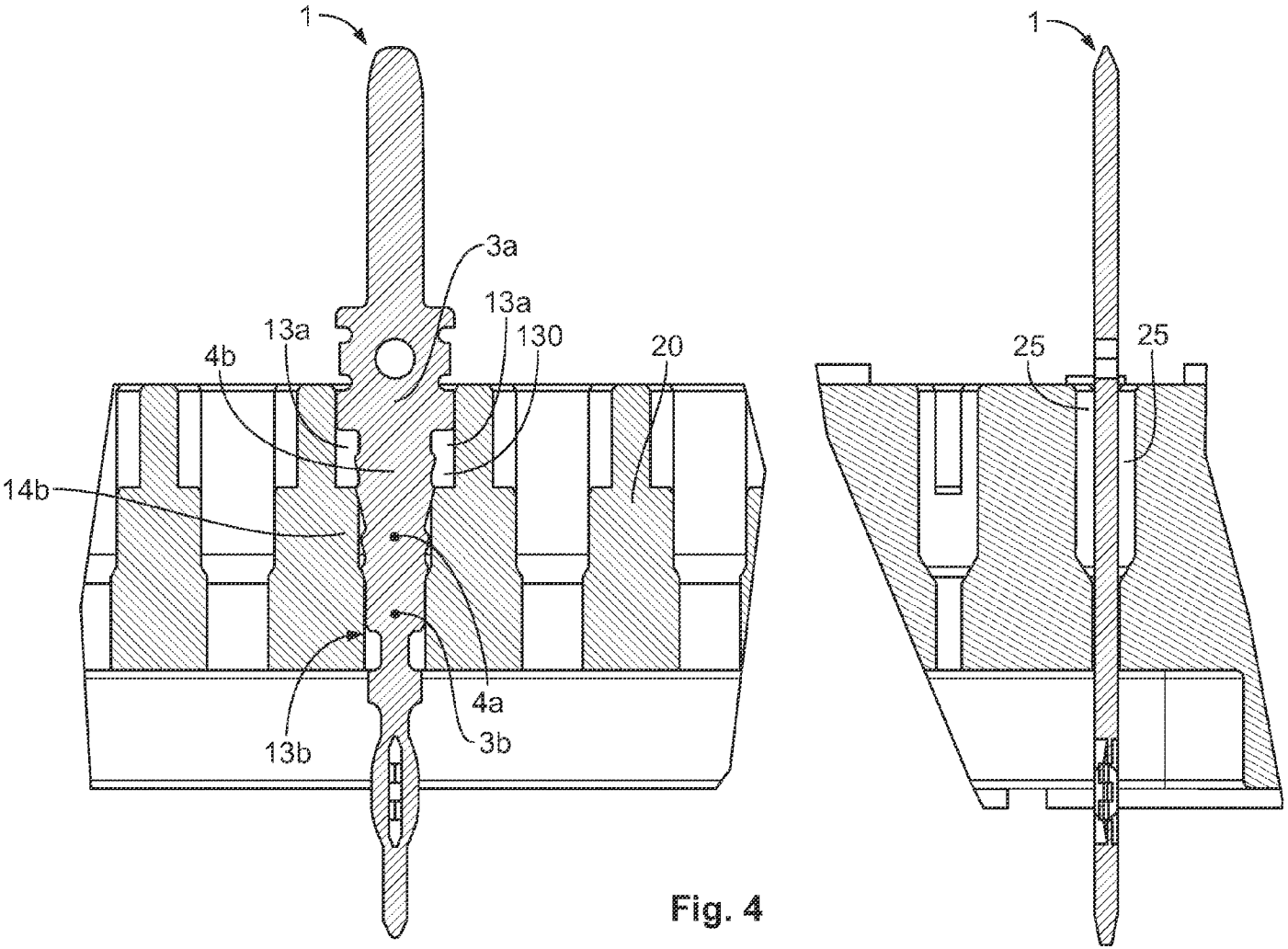
FIG. 4 shows two schematic side views of a flat contact together with a portion of a receiving block during a second step of an insertion operation.
Figure 5:
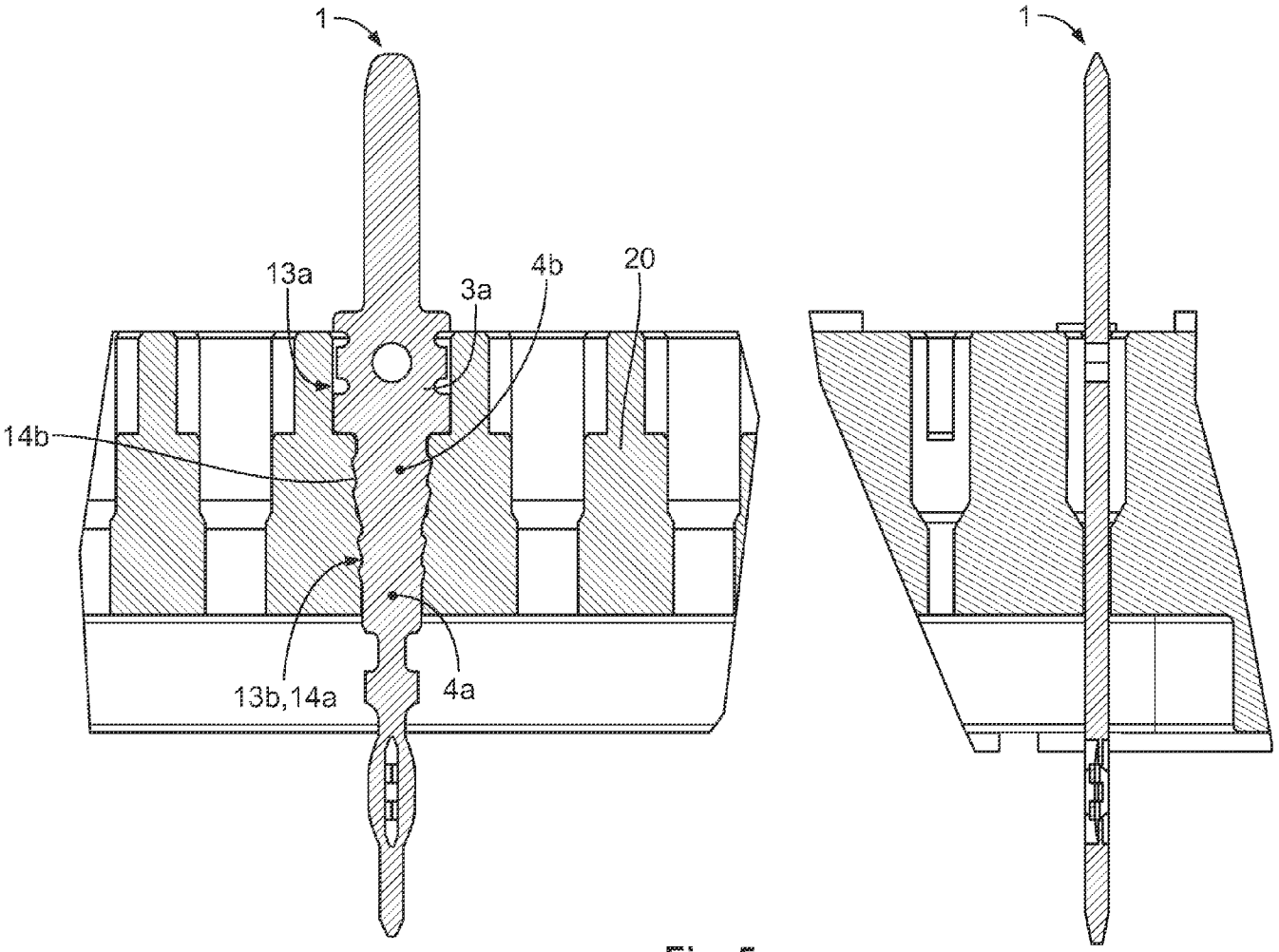
FIG. 5 shows two schematic side views of a flat contact together with a portion of a receiving block during a third step of an insertion operation.

FIGS. 3, 4 and 5 show various steps of an introduction operation in which a flat contact 1 is introduced into a receiving member 2 of a receiving block 20. Two different side views can be seen in each case. The two illustrations are each sectioned illustrations.

In FIG. 3, the flat contact 1 is only partially introduced and the portions on the flat contact 1 barely reach the corresponding counter-portions in the receiving member 2.

In FIG. 4, the corresponding portions on the flat contact 1 and on the receiving member 2 already partially overlap. For example, the first positioning portion 3*a* of the flat contact 1 is thus already partially introduced into the counter-positioning portion 13*a* of the receiving member 2. The second positioning portion 3*b* is in the second counter-positioning portion 13*b* and guides the flat contact 1 in this region. The second clamping portion 4*b* is still partially located in the region of the counter-positioning portion 3*a* and already partially in the region of the second counter-clamping portion 14*b*. The first clamping portion 4*a* is still partially located in the second counter-clamping portion 14*b*, but does not damage it owing to the small width thereof.

In FIG. 5, the flat contact 1 is introduced completely into the receiving member 2. The second counter-positioning portion 13*b* in this instance carries out the function thereof as a first counter-clamping portion 14*a* for the first clamping portion 4*a* of the flat contact 1. In order to connect to another element, for example, to a printed circuit board, the flat contact 1 protrudes from the receiving block 20 and has a resilient element.

Figure 6:
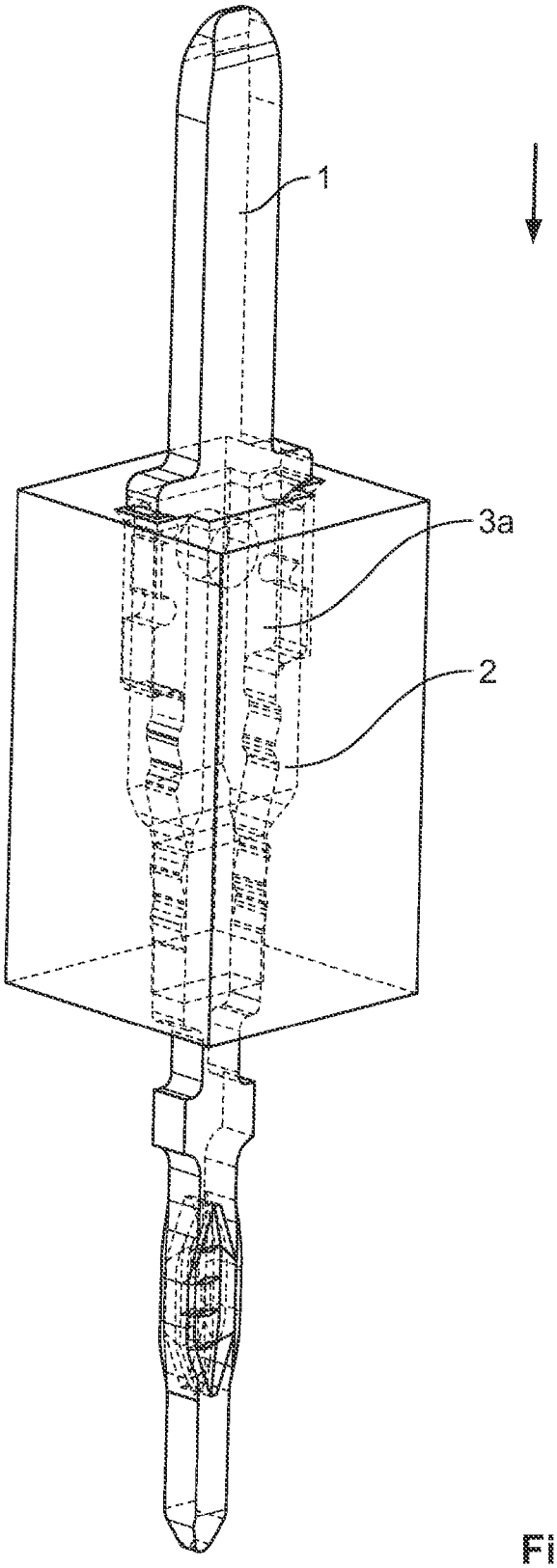
FIG. 6 is a schematic, perspective view of a flat contact in a receiving member.

FIG. 6 is a schematic view of the flat contact 1 which is introduced into the receiving member 2. It can be seen that the first positioning portion 3*a* of the flat contact 1 protrudes slightly from the receiving member 2. In an alternative embodiment, this first positioning portion 3*a* could also be completely received in the receiving member 2.

Figure 7:
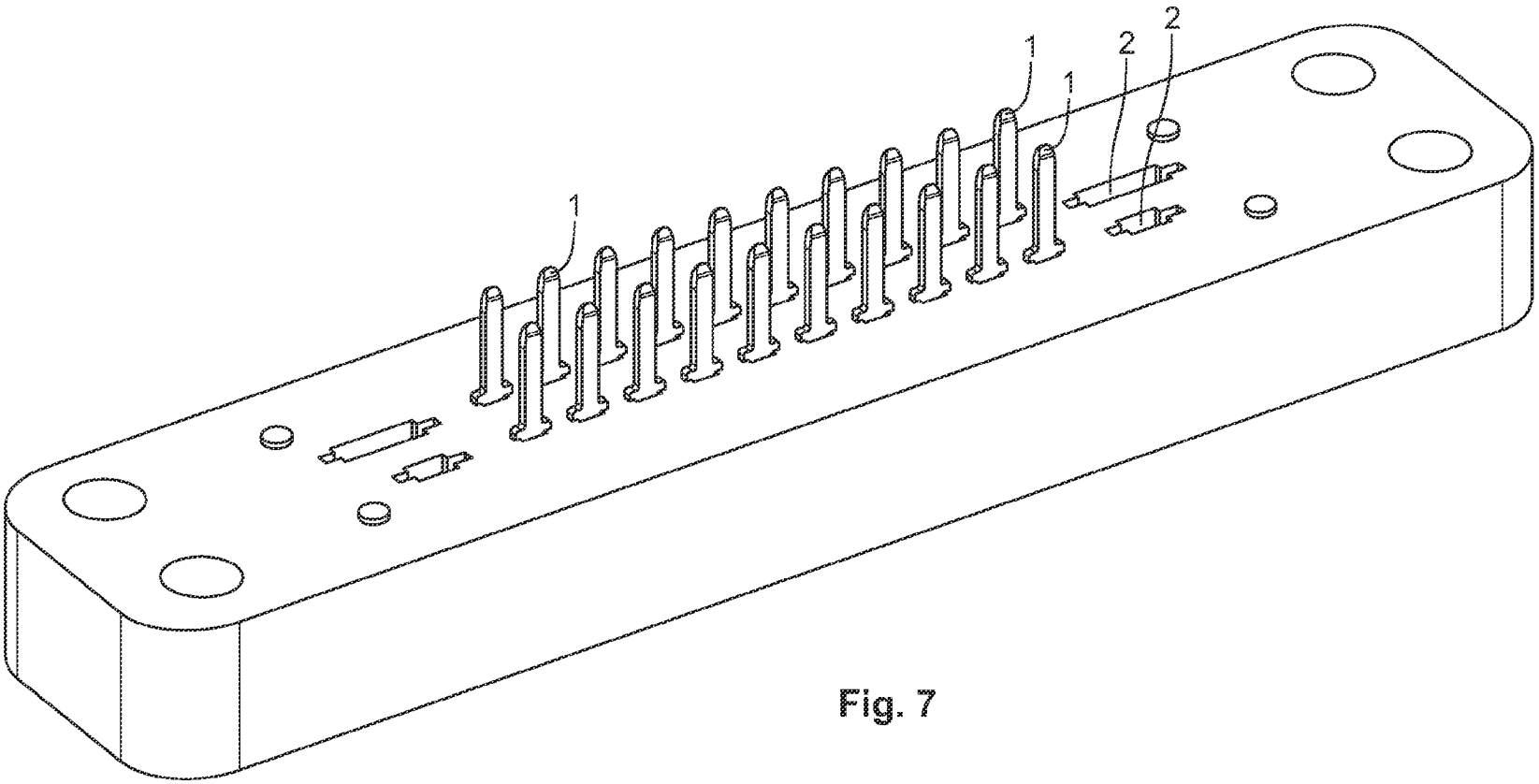
FIG. 7 is a schematic, perspective view of a connector with flat contacts in receiving members.

FIG. 7 shows a portion of a connector which comprises flat contacts 1 which are introduced into receiving members 2 of a receiving block. Counter-contact elements of a mating connector can be fitted to the portions of the flat contacts 1 which protrude from the surface.

Figure 8:
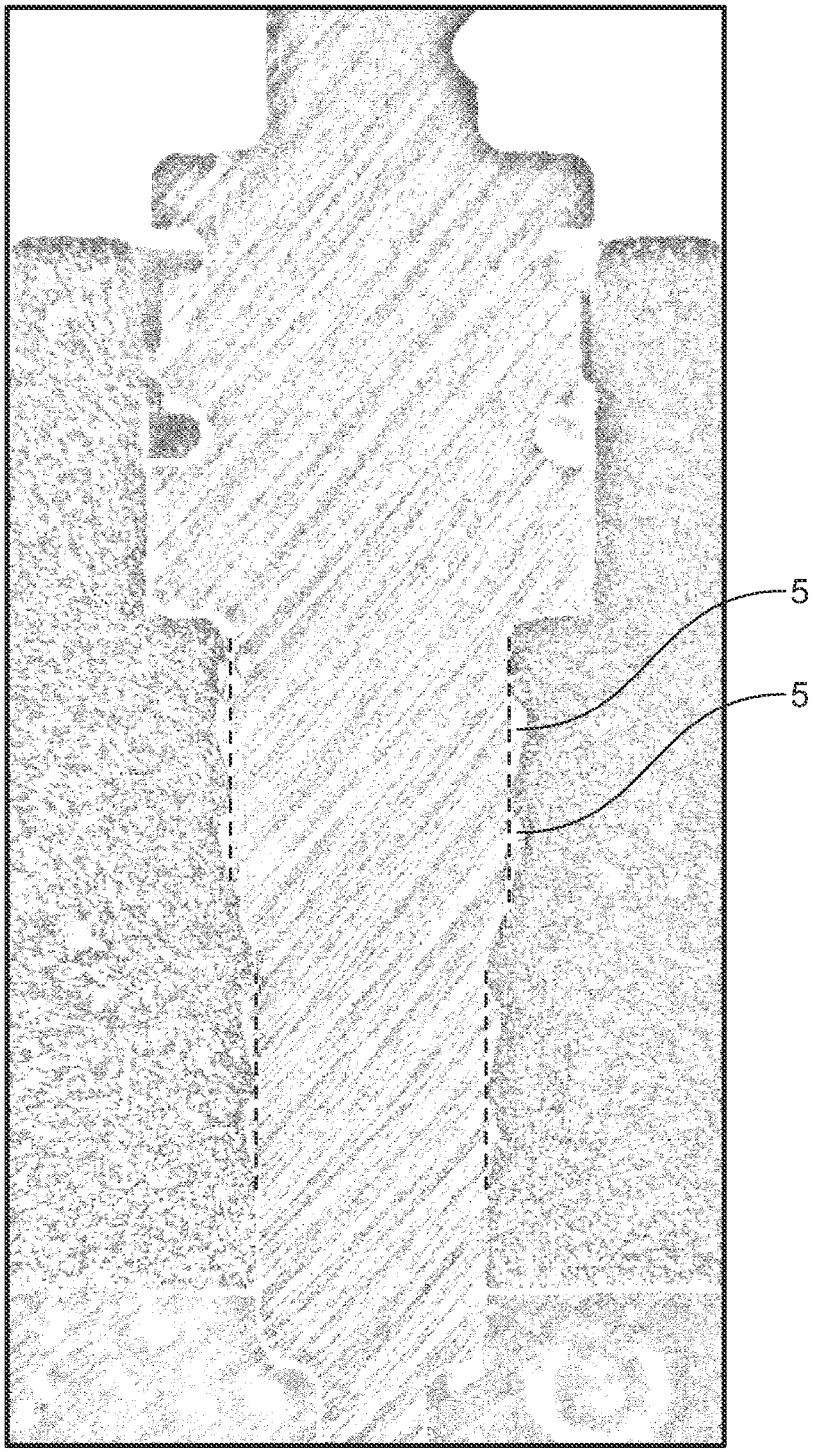
FIG. 8 is a schematic side view of a first variant of a flat contact in a receiving member.
Figure 9:
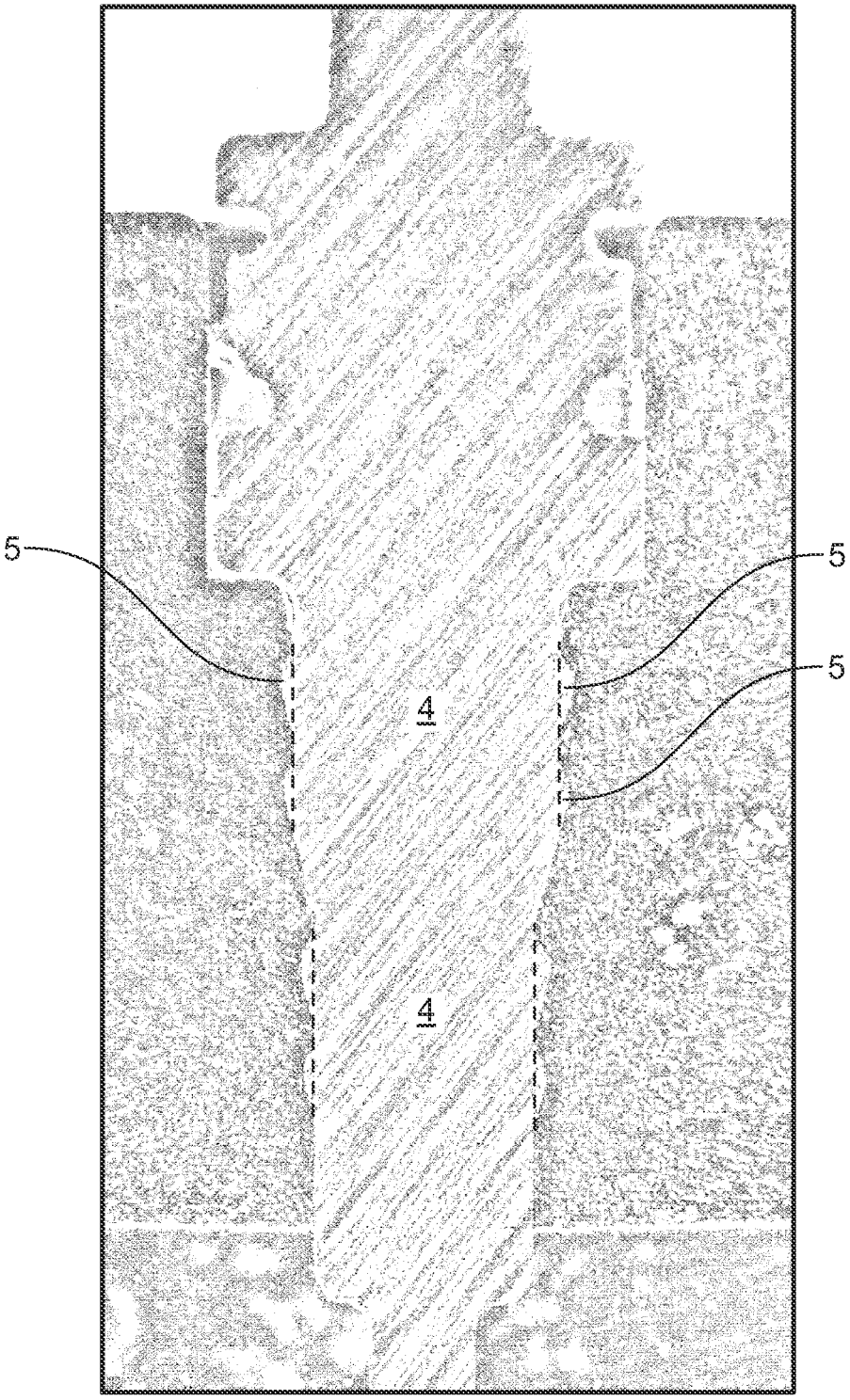
FIG. 9 is a schematic sectioned view of a second variant of a flat contact in a receiving member.
Figure 10:
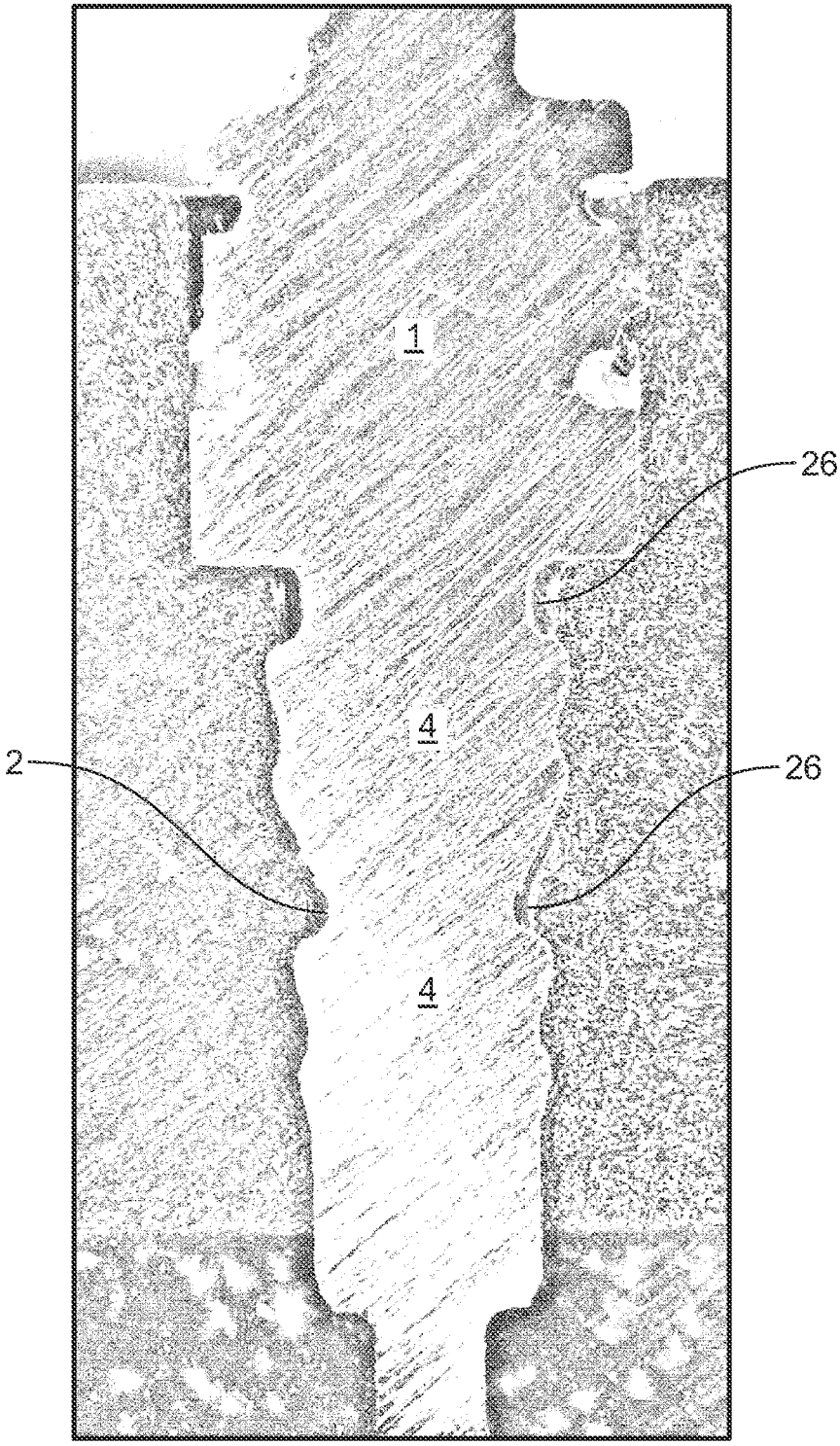
FIG. 10 is a schematic sectioned view of a third variant of a flat contact in a receiving member.

FIGS. 8, 9 and 10 are sectioned illustrations of differently constructed flat contacts 1 in a state received in a receiving member 2. The embodiments of FIGS. 8 and 9 are different in terms of the height of the clamping projections 5. In FIG. 8, the clamping projections 5 protrude further from a base 8 than in the embodiment of FIG. 9. The embodiment of FIG. 10 additionally has two neck portions 26 which may serve to receive the material deformed by the clamping projections 5 of the clamping portions 4 and thereby to achieve a better positive-locking connection.

LIST OF REFERENCE NUMERALS

1 Flat contact
2 Receiving member
3 Positioning portion
3*a* First positioning portion
3*b* Second positioning portion
4 Clamping portion
4*a* First clamping portion
4*b* Second clamping portion
5 Clamping projection
6 Guiding faces
7 Narrow sides
8 Base
9 Introduction opening
13 Counter-positioning portion
13*a* First counter-positioning portion
13*b* Second counter-positioning portion
14 Counter-clamping portion
14*a* First counter-clamping portion
14*b* Second counter-clamping portion
16 Counter-guiding face
20 Receiving block
21 Inclined introduction member
22 Inclined face
23 Support faces of the counter-positioning portion
24 Support faces of the counter-clamping portion
25 Recess
26 Neck portion
130 Part-portions of a counter-positioning portion
D Thickness direction
E Insertion direction
B Width direction
BP1 Width of the first positioning portion
BP2 Width of the second positioning portion
BK1 Width of the first clamping portion
BK2 Width of the second clamping portion
BB1 Width of the base of the first clamping portion
BB2 Width of the base of the second clamping portion
WP1 Inner width of the first counter-positioning portion
WP2 Inner width of the second counter-positioning portion
WK1 Inner width of the first counter-clamping portion
WK2 Inner width of the second counter-clamping portion
d Thickness of the flat contact
$d_{23}$ Spacing of the support faces in the counter-positioning portion
$d_{24}$ Spacing of the support faces in the counter-clamping portion

The invention claimed is:

1. A flat contact for insertion in a receiving member of a connector in an insertion direction (E), comprising a clamping portion having clamping projections which protrude in a width direction (B), a first positioning portion which has at the narrow sides thereof guiding faces which extend parallel with the insertion direction (E), wherein the guiding faces project beyond the clamping projections in the width direction (B), a second positioning portion having guiding faces which extend parallel with the insertion direction (E), wherein the clamping portion is located between the first positioning portion and the second positioning portion, wherein in the clamping portion the clamping projections protrude from a base with a width (BB1) which remains consistent in the insertion direction (E) and the width (BB1) of the base in the clamping portion corresponds to the width (BP2) of the second positioning portion.

2. The flat contact according to claim 1, wherein the width (BP1) of the first positioning portion is between 120 and 500% of the width (BK2) of the clamping portion.

3. The flat contact according to claim 1, wherein the width (BP1) of the first positioning portion is between 120 and 200% of the width (BK2) of the clamping portion.

4. The flat contact according to claim 1, wherein the width (BP1) of the first positioning portion is between 130 and 150% of the width (BK2) of the clamping portion.

5. The flat contact according to claim 1, wherein the width (BP1) of the first positioning portion is from 150 to 500% of the width (BP2) of the second positioning portion.

6. The flat contact according to claim 1, wherein the width (BP1) of the first positioning portion is from 180 to 250% of the width (BP2) of the second positioning portion.

7. The flat contact according to claim 1, wherein the first positioning portion is wider than the clamping portion and the clamping portion is wider than the second positioning portion.

8. The flat contact according to claim 1, wherein the flat contact has two clamping portions which are located one behind the other in the insertion direction (E) and in which clamping projections protrude in each case from a base with a width (BB1, BB2) which remains consistent in the insertion direction (E), wherein the base of a first clamping portion has a smaller width (BB1) than the base of a second clamping portion which is located downstream of the first clamping portion in the insertion direction (E).

9. The flat contact according to claim 8, wherein the width (BB1) of the first clamping portion is from 25 to 90% of the width (BB2) of the base of the second clamping portion.

10. The flat contact according to claim 8, wherein the width (BB1) of the first clamping portion is from 70 to 90% of the width (BB2) of the base of the second clamping portion.

11. The flat contact according to claim 8, wherein the width (BB1) of the first clamping portion is from 80 to 85% of the width (BB2) of the base of the second clamping portion.

12. A receiving block for inserting a flat contact in an insertion direction (E), comprising at least one receiving member for the flat contact, wherein the receiving member has a counter-positioning portion having counter-guiding faces which extend parallel with the insertion direction (E) and a counter-clamping portion, wherein an inner width (WP1) of the counter-positioning portion measured in a width direction (B) which extends perpendicularly relative to the insertion direction (E) is greater than an inner width (WK2) of the counter-clamping portion, wherein the counter-positioning portion comprises two part-portions which are located at two ends of the receiving member located in the width direction (B) and which are separated by a recess, and wherein a thickness of the recess in a thickness direction (D) which extends perpendicularly relative to the width direction (B) is greater than a thickness of the two part-portions.

13. The receiving block according to claim 12, wherein the inner width (WP1) of the counter-positioning portion is between 120 and 500% of the inner width (WK2) of the counter-clamping portion.

14. The receiving block according to claim 12, wherein the inner width (WP1) of the counter-positioning portion is between 120 and 200% of the inner width (WK2) of the counter-clamping portion.

15. The receiving block according to claim 12, wherein the inner width (WP1) of the counter-positioning portion is between 130 and 150%, of the inner width (WK2) of the counter-clamping portion.

16. The receiving block according to claim 12, wherein the second counter-positioning portion acts as a counter-clamping portion.

17. The receiving block according to claim 12, wherein the counter-positioning portion and/or the counter-clamping portion have support faces which oppose each other in the thickness direction (D) and whose spacing ($d_{23}$, $d_{24}$) in the thickness direction (D) is adapted to the thickness (d) of the flat contact in the clamping portion or positioning portion.

18. The receiving block according to claim 12, wherein the receiving member has a second counter-positioning portion and the counter-clamping portion is located between the first counter-positioning portion and the second counter-positioning portion.

19. The receiving block according to claim 18, wherein the inner width (WP1) of the first counter-positioning portion is from 150 to 500% of the inner width (WP2) of the second counter-positioning portion.

20. The receiving block according to claim 18, wherein the inner width (WP1) of the first counter-positioning portion is from 180 to 250% of the inner width (WP2) of the second counter-positioning portion.

21. A connector, comprising:

a flat contact having a clamping portion having clamping projections which protrude in a width direction (B) and a positioning portion which has at the narrow sides thereof guiding faces which extend parallel with the insertion direction (E), wherein the guiding faces project beyond the clamping projections in the width direction (B);

a receiving block comprising at least one receiving member for the flat contact, wherein the receiving member has a counter-positioning portion having counter-guiding faces which extend parallel with the insertion direction (E) and a counter-clamping portion, wherein an inner width (WP1) of the counter-positioning portion measured in a width direction (B) which extends perpendicularly relative to the insertion direction (E) is greater than an inner width (WK2) of the counter-clamping portion, wherein the counter-positioning portion comprises two part-portions which are located at two ends of the receiving member located in the width direction (B) and which are separated by a recess, and wherein a thickness of the recess in a thickness direction (D) which extends perpendicularly relative to the width direction (B) is greater than a thickness of the two part-portions.

* * * * *